United States Patent [19]

Patel et al.

[11] 4,315,758

[45] Feb. 16, 1982

[54] PROCESS FOR THE PRODUCTION OF FUEL GAS FROM COAL

[75] Inventors: Jitendra G. Patel, Bolingbrook; William A. Sandstrom, Chicago; Paul B. Tarman, Elmhurst, all of Ill.

[73] Assignee: Institute of Gas Technology, Chicago, Ill.

[21] Appl. No.: 85,934

[22] Filed: Oct. 18, 1979

[51] Int. Cl.[3] ..... C10J 3/54

[52] U.S. Cl. ..... 48/197 R; 48/202; 48/206

[58] Field of Search ..... 48/203, 206, 202, 197 R; 201/31, 38, 9

[56] References Cited

U.S. PATENT DOCUMENTS

| | | | |
|---|---|---|---|
| 2,906,608 | 9/1959 | Jequier et al. | 48/206 |
| 3,322,321 | 5/1967 | Cockerham | 48/63 |
| 3,884,649 | 5/1975 | Matthews | 48/203 |
| 3,935,825 | 2/1976 | Matthews et al. | 48/206 |
| 3,981,690 | 8/1976 | Chen et al. | 48/203 |
| 4,023,280 | 5/1977 | Schora et al. | 48/197 R |
| 4,077,778 | 3/1978 | Nahas et al. | 48/197 R |
| 4,094,650 | 6/1978 | Koh et al. | 48/202 |
| 4,135,889 | 1/1979 | Mori | 48/197 R |
| 4,135,982 | 1/1979 | Green | 201/12 |
| 4,191,539 | 3/1980 | Patel et al. | 48/203 |
| 4,229,289 | 10/1980 | Victor | 48/206 |

*Primary Examiner*—Kenneth M. Schor
*Assistant Examiner*—Michael Goldman
*Attorney, Agent, or Firm*—Allegretti, Newitt, Witcoff & McAndrews

[57] ABSTRACT

An improved apparatus and process for the conversion of hydrocarbonaceous materials, such as coal, to more valuable gaseous products in a fluidized bed gasification reaction and efficient withdrawal of agglomerated ash from the fluidized bed is disclosed. The improvements are obtained by introducing an oxygen containing gas into the bottom of the fluidized bed through a separate conduit positioned within the center of a nozzle adapted to agglomerate and withdraw the ash from the bottom of the fluidized bed. The conduit extends above the constricted center portion of the nozzle and preferably terminates within and does not extend from the nozzle. In addition to improving ash agglomeration and withdrawal, the present invention prevents sintering and clinkering of the ash in the fluidized bed and permits the efficient recycle of fine material recovered from the product gases by contacting the fines in the fluidized bed with the oxygen as it emanates from the conduit positioned within the withdrawal nozzle. Finally, the present method of oxygen introduction permits the efficient recycle of a portion of the product gases to the reaction zone to increase the reducing properties of the hot product gas.

7 Claims, 3 Drawing Figures

GASIFIER
PRODUCT GAS
30
28
26
20
22
SECOND CYCLONE
FIRST CYCLONE
COAL
8
6
2
5
LOCK HOPPER
10
34
24
FLUIDIZED BED
4
32
CARRIER GAS
16
12
14
18
43
42
38
SLOPING GRID
46
50
36
CENTRAL JET
40
44
VENTURI
48
52
STEAM/OXYGEN
56
STEAM/OXYGEN
54
ASH AGGLOMERATES
WATER
62
60
64
ASH AGGLOMERATE SLURRY

PROCESS FOR THE PRODUCTION OF FUEL GAS FROM COAL

The Government of the United States of America has rights to this invention pursuant to Contract No. EF-77-C-01-2582 awarded by the U.S. Department of Energy.

BACKGROUND OF THE INVENTION

The present invention relates to a process and apparatus for the conversion of solid, hydrocarbonaceous materials such as coal to a more valuable gaseous product. In particular, the present invention relates to a fluidized bed coal gasification reaction wherein coal is gasified and by-product ash is efficiently withdrawn.

As natural gas and crude oil supplies become uncertain, it has become necessary to search for alternative energy sources. Because of its ready availability in the United States, coal has increasingly been looked at as an alternate energy source for natural gas and crude oil. Unfortunately, however, much of the coal in the United States has a high sulfur content which, when burned directly, can lead to substantial atmospheric pollution and acid rain. By way of example, it has been estimated that the combustion products of coal contribute one-eighth of the total atmospheric pollutants emitted in the United States including one-half of the sulfur oxides and one-fourth of both the nitrogen oxides and particulate matter.

Sulfur emissions from coal combustion may be reduced by several methods. These methods include using low sulfur coal; cleaning high sulfur coal by physical methods to remove the sulfur from the coal; removing sulfur from the coal during the combustion thereof; producing a de-ashed low sulfur solid fuel by the solvent processing of coal; and, lastly, gasifying coal and removing the sulfur from the resultant gas prior to combustion of the gasified coal products.

The last method, coal gasification with cleaning of the resultant gas products prior to combustion, appears to offer the greatest reduction in sulfur emissions since most of the sulfur present in the gasified coal appears as hydrogen sulfide. The removal of this hydrogen sulfide, however, from the gasified coal, presents no great problem since several different commercial gas cleaning processes are available today which can reduce the hydrogen sulfide content of a gaseous stream, such as produced in a coal gasification reaction, to less than 10 ppm. In fact, some processes can produce gaseous streams containing hydrogen sulfide of 1 ppm or less.

A preferred method for the gasification of coal is the U-GAS Process developed by the Institute of Gas Technology in Chicago, Ill. (See the Oil and Gas Journal—Aug. 1, 1977, p. 51 et seq., the teachings of which are incorporated herein by reference). The U-GAS Process is capable of producing a clean, environmentally acceptable low BTU (about 150–300 BTU/SCF) fuel gas from coal. This gas can be used directly by industrial and commercial users or as a substitute for natural gas or fuel oil. In the form of synthesis gas, the products from the U-GAS Process can be used as a chemical feedstock or as a source of hot reducing gas for reducing metallic ores such as iron ore to the base metal. In this latter application, it is desirable to have a high ratio of carbon monoxide and hydrogen to steam and water in the hot product gases because of the high reducing properties of carbon monoxide and hydrogen.

In the U-GAS Process, the gasification reaction is performed at high temperatures since this maximizes the production of carbon monoxide and hydrogen. Preferred gasification temperatures for the U-GAS Process are in the range of 1500° to 2000° F. and preferably 1600° to 1900° F. Lower temperatures are not desirable since this leads to the production of high amounts of carbon dioxide and water. However, one of the potential problems encountered in the high temperature gasification of coal in any gasification process including the U-GAS Process is the fusion of ash particles at the high temperatures encountered in the gasification reaction. These high temperatures cause the ash particles to become sticky and agglomerate within the reaction zone. Accordingly, although temperatures in excess of 1700° F. are desirable for coal gasification, it is difficult to substantially exceed 1950° F. since temperatures substantially in excess of 2000° F. lead to the formation of sticky ash particles that can agglomerate to form large ash particles that are difficult to remove from the fluid bed.

One method of removing agglomerated ash particles from a fluid bed reactor, the basic principles of which are used in the U-GAS Process, is illustrated in Jequier et al, U.S. Pat. No. 2,906,608, the teachings of which are incorporated by reference herein. In this apparatus, an inverted conical withdrawal section is positioned in the bottom of the fluid bed reactor to provide a venturi-type nozzle having a constricted center section. A high velocity air-steam stream is passed up through this inverted conical section and reacts with coal therein to create locally higher temperatures within the confined cone positioned at the bottom of the reactor. Within this inverted cone the ash particles are heated to temperatures sufficient to render them sticky whereby they gradually agglomerate and become larger in mass and size. When they reach a predetermined value, size and/or weight, the velocity of the gas stream rising up through the cone becomes insufficient to keep these agglomerated particles in the fluid bed and the particles descend down through the narrow bottom portion of the inverted cone and are withdrawn from the fluid bed reaction zone in a relatively efficient manner. Because the velocity of the gaseous material passing up through the cone always exceeds the settling velocity of the finely divided coal particles in the fluid bed per se, the agglomerated ash particles can be selectively removed without removal of the coal particles from the fluidized bed proper.

A problem associated with a venturi-type apparatus, as illustrated in Jequier et al, is that extremely high temperatures are present in the conical withdrawal section. For example, the temperatures within the conical withdrawal zone are at least 100° and often 200° higher than the temperatures encountered in the fluid bed proper. Since the abrasive agglomerated ash particles are in constant physical contact with the walls of the cone and because of the high temperatures present therein, exotic expensive alloys are required to manufacture a long lasting withdrawal cone. Most importantly, since the gas stream that forms the ash agglomerates is the same as the stream separating or classifying the agglomerates from the fluidized bed, unusual restrictions are imposed on the rate and composition of gas flow. In addition, sintering can take place in the venturi and plugging of the nozzle can occur particularly when fine coal material recovered from the product gases are recycled back to the fluidized bed through the venturi nozzle. Because the plugging occurs in a zone of high temperature, a fused adherent mass can form and lead to an undesired premature reactor shutdown.

Chen et al, U.S. Pat. No. 3,981,690 teaches the undesirability of utilizing a venturi nozzle such as Jequier et al in a coal gasification process and, instead, suggests a process for gasifying coal in a narrow, spout fluidized bed wherein air entering a central tube is contacted with feed coal in an annular section at the bottom portion of a relatively small diameter reactor. Ash is formed in the bottom of the reactor and removed downward through the annulus. This method of simultaneous coal addition and ash withdrawal does not recognize the necessity of providing an introduction point separate from the fresh coal feed point, the importance of the location of the central tube relative to the fluid bed and the ash withdrawal annulus, and the importance of controlled, oxygen concentration at the bottom of the fluidized bed including high oxygen concentrations near the central tube to provide efficient ash agglomeration and withdrawal.

SUMMARY OF THE INVENTION

It is an object of the present invention to provide an efficient method of adding an oxygen containing gas, particularly a gas having a high oxygen content to a fluidized bed reaction zone for the conversion of a hydrocarbonaceous solid such as coal to a gaseous product while efficiently agglomerating the ash in the coal.

It is another object of the present invention to efficiently recycle coal fines, as recovered from a fluidized bed reaction wherein coal is converted to a gaseous product, back to the bed for further conversion.

It is still another object of the present invention to maximize the amount of carbon monoxide and hydrogen present in the hot gaseous reaction product produced in a coal gasification reaction.

It has been discovered that ash can be effectively withdrawn from a process for the conversion of a solid agglomerating hydrocarbonaceous solid such as coal to a more valuable gaseous product, such as the U-GAS Process, wherein (i) an oxygen containing gas in admixture with steam is contacted with the solid at elevated temperatures in a fluidized bed reaction zone;

(ii) ash is agglomerated in the bottom portion of the reaction zone and the agglomerated ash is withdrawn from the reaction zone through a withdrawal nozzle having a constricted central opening.

According to the present invention, the tendency for the ash to sinter and occlude in the nozzle and the central opening in this process is controlled, if not eliminated, by passing an oxygen containing gas into the nozzle, through a separate conduit, concentrically positioned within the nozzle. The discharge end of the conduit must, however, be positioned above the constricted central opening and preferably does not extend beyond the entrance to the nozzle.

Preferably, the oxygen concentration of the gas passing through the separate conduit is high, e.g. exceeds 20% volume, up to and including pure oxygen. Particularly preferred are oxygen concentrations of about 30–75%, the balance being an inert gas, $CO_2$ or steam.

In a particularly preferred embodiment of the present invention, additional gas is passed up into the reactor through the nozzle. This nozzle gas stream contains substantially less oxygen than the gas passing through the centrally positioned conduit. Preferably, the oxygen concentration of the gas passing up through the nozzle is about 0–15% by volume, the balance being steam, $CO_2$ or an inert gas.

The method of oxygen introduction and ash withdrawal described permits the coal fines, as discharged from the fluidized bed in admixture with the gaseous reaction products, to be effectively recycled, after recovery, back to the fluidized bed reactor zone by injecting the recycled fines into the oxygen containing gas substantially instantaneously as the oxygen is discharged from the conduit concentrically positioned within the withdrawal nozzle. This method of fines recycle insures gasification of the fines without undue sintering or deposition thereof within the nozzle.

Another advantage of the present invention is that it permits the optimization of the amount of carbon monoxide and hydrogen present in the hot gaseous product. The chief gasification reactions which occur in the fluidized reaction bed include:

$$C+H_2O \rightarrow CO+H_2 \quad (1)$$

$$CO+H_2O \rightarrow CO_2+H_2 \quad (2)$$

$$C+\tfrac{1}{2}O_2 \rightarrow CO \quad (3)$$

$$C+CO_2 \rightarrow 2CO \quad (4)$$

Reaction (2) takes place in the gaseous phase and, at operating temperatures of 1800°–2000° F., proceeds very rapidly to equilibrium. The other reactions, however, are slower.

The gases introduced to the fluidized reaction bed serve two roles; first, to fluidize the particles of char and second, to react with the particles. Steam is the usual fluidizing/reactant gas. Reaction (1), however, is endothermic. The heat necessary to permit this reaction to occur is supplied by adding enough oxygen, either pure, as air, or as a mixture of the two, to react with the bed carbon to supply heat. Steam need not be the only reactant gas. Carbon dioxide can be used as well, as reaction (4) shows.

To control the temperature in the fluidized bed and to aid in the kinetics of chemical reaction, excess steam and $CO_2$ are usually added to the gasifier. The unreacted steam and $CO_2$ exits from the gasifier and become part of the product gas and can ordinarily be removed from the product gas and recycled with little difficulty. When hot reducing gases are required, however, the product gas cannot be cooled to remove the steam and $CO_2$ without a penalty in wasted energy. The ratio of $CO+H_2$ to $CO_2+H_2O$ in the hot product gas thus becomes important. Therefore, if steam and $CO_2$ are decreased in the hot product gas, the $CO+H_2$ ratio can be increased. An increase in the $CO+H_2$ ratio can be accomplished by replacing a portion of the excess steam and $CO_2$ with recycled product gases which also contain CO and $H_2$. This further avoids introduction of any inerts. This recycle of a portion of the product gases could not be effectively utilized in the prior art since in the prior art process oxygen enters the gasification reactor zone (in addition to the central introduction point) at numerous points at the bottom of the reactor through a grid distributor positioned around the central introduction point. This added oxygen passing through the grid would burn the CO and $H_2$ in the recycled product gas if these gases were introduced through the grid. Our discovery of a way to introduce oxygen to the fluidized bed only through a central separate conduit in the center of the central introduction point, i.e. venturi and only steam at the surrounding grid, enables the return of part of the gasifier product gas through the grid along with steam. This recycle of product gas can be accomplished by cooling a portion of the gasifier product gas in a water quench, removing steam and $CO_2$ if necessary, compressing the gas slightly and returning it to the grid distributor for contact with the fluidized reaction bed. This will reduce the steam requirement, and will alter the composition of the gasifier product gas so that the hot product gas becomes highly reducing and the ratio $$(CO+H_2)/(CO_2+H_2O)$$

can be controlled to desired levels. This application is preferably utilized when the hot product gas is used for iron ore reduction with the spent reactant gas from the iron ore reducing section being recycled back to the gasification reaction.

DETAILED DESCRIPTION OF THE PRESENT INVENTION

Figure 1:
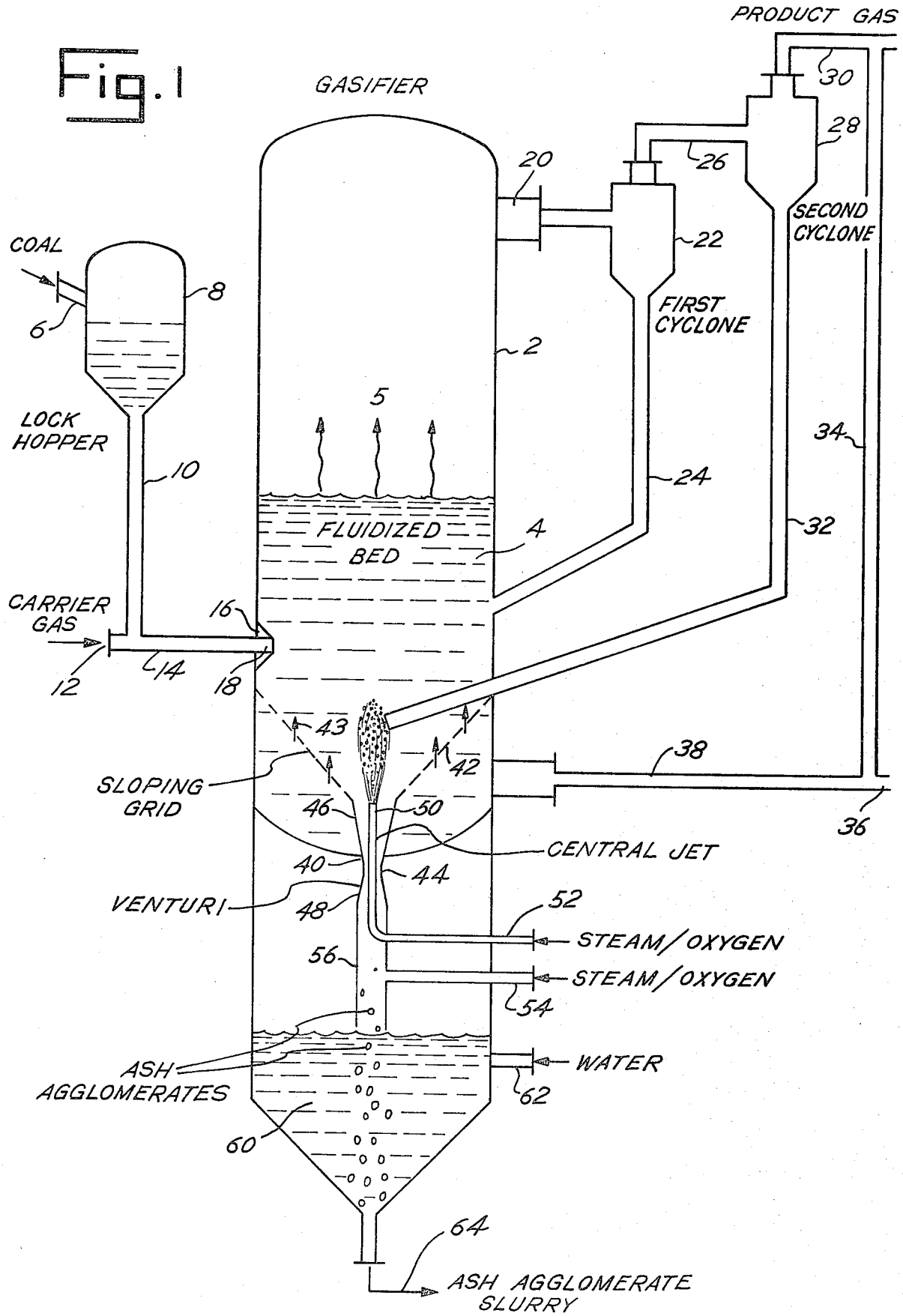
FIG. 1 is a schematic diagram of a fluidized bed gasification reactor system illustrating the principles of the present invention.
Figure 2:
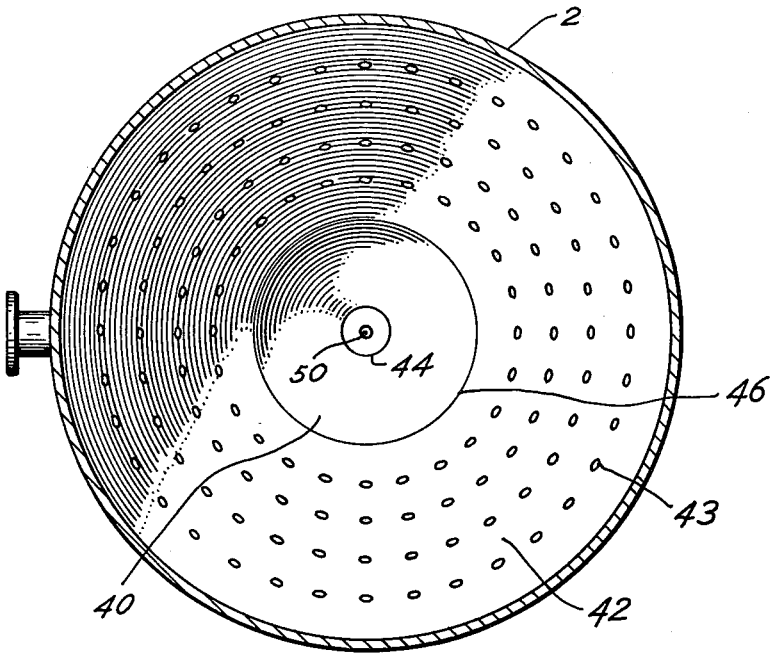
FIG. 2 is a cross section view taken along section line 2—2 of FIG. 1.
Figure 3:
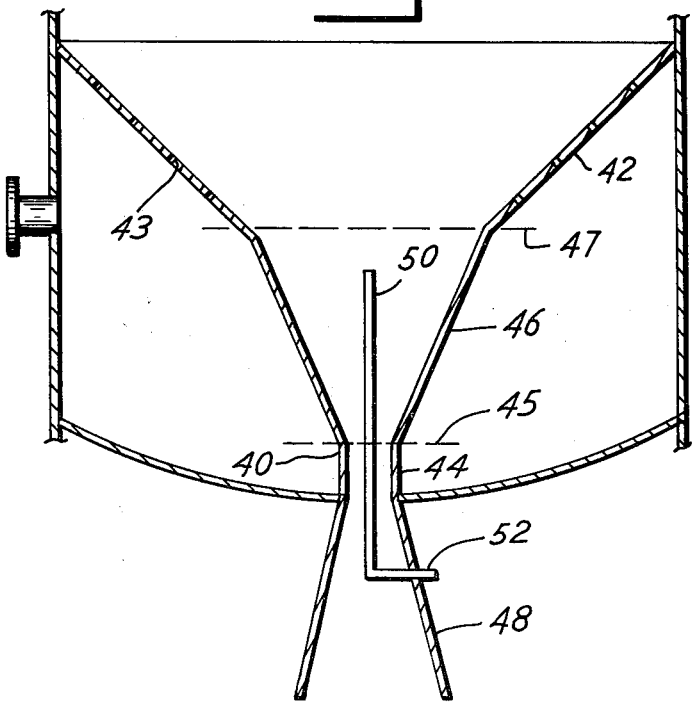
FIG. 3 is a detailed diagram of the bottom portion of the gasification reactor illustrated in FIG. 1 showing in detail the relationship of the oxygen injection conduit and the venturi withdrawal nozzle.

As illustrated in FIG. 1, gasification reactor 2 is a fluidized bed gasification reactor operated at conventional conditions of temperature and pressure for the conversion of agglomerating solid hydrocarbonaceous particles, preferably caking bituminous coal, to more valuable gaseous products such as low BTU fuel gas in fluidized reaction bed 4. Preferred are operating temperatures of about 1800°–2000° F. and pressures of about 50–200 psig. In the process illustrated, pulverized feed coal enters lock hopper 8 through feed line 6 where it is temporarily stored before being removed via line 10. The feed coal is then admixed with a gaseous conveyance medium (preferably steam), entering line 12, and passed via line 14 to gasification reactor 2 at a velocity of about 20–50 ft/sec. The fresh feed coal 2 enters gasification reactor 2 through conduit 18 which extends a short distance (about 1–6") into the fluidized bed 4 contained in the bottom portion of reactor 2. A conical refractory lining 16 surrounds conduit 18 to deflect slow moving solids passing down the reactor wall. This method of coal introduction directly into fluidized bed 4 renders unnecessary prior pretreatment or devolatilization of the coal.

Fluidized bed 4 comprises an admixture of steam and oxygen (entering from the bottom in a manner to be described in detail later); fresh feed coal and char which, at reaction conditions produces a reaction effluent 5 comprising an admixture of carbon oxides, steam, hydrogen, hydrocarbons and entrained coal fines. Effluent 5 is removed from exit 20 and is passed to first stage cyclone 22. Within cyclone 22, the coarse fines (about 20 to 250 microns in diameter) are separated from the product effluent and are returned via line 24 directly to fluidized bed 4.

The overhead or gaseous effluent from cyclone 22 is removed from the top portion of cyclone 22 via line 26 and is then passed to second stage cyclone 28 wherein additional fine material (about 5 to 100 microns in diameter) is recovered and passed in a manner to be described in greater detail later via line 32 to a specific location within the bottom portion of fluidized bed 4. Product gas stream 30 is removed from the top portion of cyclone 28 for further treatment, partial recycle and/or use.

In accordance with the present invention, the steam and substantially all of the oxygen necessary to maintain the gasification reaction in fluidized bed 4 enters the bottom of gasification reactor 2 through venturi nozzle 40 and conduit 50 concentrically positioned within venturi nozzle 40. Specifically, the cooperative action of the mixture of steam and oxygen entering venturi 40 through line 54 and the mixture of steam and oxygen entering concentrically positioned conduit 50 through line 52 function to selectively agglomerate and remove ash from the bottom portion of the fluidized bed 4.

Venturi nozzle 40 comprises an upward extending conical section 46, a constricted center section 44 and a downwardly extending conical section 48. In accordance with the present invention, centrally positioned conduit 50 must be positioned within conical section 44 above dotted line 45 and preferably terminates within upwardly extending conical section 46 below dotted line 47. As described earlier, the oxygen concentration, i.e. oxygen to steam ratio, of the gases emitted upward from concentrically positioned conduit 50 are substantially higher than the oxygen concentration in the steam-oxygen mixture passed upward through venturi 40. Although the oxygen content in venturi 40, as determined by incoming stream 54, can be as high as about 20% oxygen, preferred oxygen concentrations are less than 15%. Similarly, although the oxygen concentration of stream 52 as emitted through centrally positioned conduit 50 can be as high as 100%, preferably the oxygen concentration is in the range of about 30–75%. It has been discovered that by adhering to these limitations and relative ratios of oxygen concentration, it is possible to maintain high ash concentrations in fluidized bed 4 without sintering of ash on the fluid distribution grid or surface 42. Specifically, steady state operations can accommodate ash concentrations as high as 80–85% in fluidized bed 4 without sintering or clinkering of the ash in the bed.

Additional steam, gasification or fluidization medium is preferably added to gasification zone 2 through inlet 38 to assist in maintaining the proper residence time distribution and flow patterns through fluidized bed 4. Preferably steam is introduced into fluidized bed 4 through inlet 38 by introducing the steam beneath supporting grid 42 concentrically surrounding venturi 40. The steam then passes upwardly through openings 43 in grid 42 for contact with the fluidized bed. Preferably, the steam passing upward through grid 42 and into fluidized bed 4 is substantially free of oxygen. Preferred are oxygen concentrations in the steam of less than 5% in stream 38. Particularly preferred are steam streams containing essentially no oxygen. It has been discovered that by introducing substantially all of the oxygen necessary to maintain the gasification reaction through a single centrally positioned venturi having a tube centrally positioned therein, wherein a high oxygen concentration is present in the tube and a substantially lesser oxygen concentration is present in the venturi that substantially no oxygen need be introduced into reactor 2 through the surrounding grid 42. As a result, sintering of ash is eliminated and the ash is effectively agglomerated and withdrawn by the cooperative action of venturi 40 and centrally positioned tube 50.

In addition, the absence of oxygen in the steam entering reactor 2 through inlet 38 permits a portion of the product gas containing carbon monoxide and hydrogen to be recycled to the lower portion of fluidized bed 4 so as to produce a final hot product gas having high reducing properties and a high ratio of carbon monoxide and hydrogen. In accordance with the present invention, a portion of the product gas passing from cyclone 28 via line 30 is withdrawn via line 34, cooled to remove steam and, if desired, $CO_2$, compressed and admixed with a steam entering through line 36 for introduction through inlet 38 to the lower portion of fluidized bed 4.

The gaseous medium introduced via inlet 38 and conduits 52 and 54 are adjusted to provide a superficial gas velocity through fluidized bed 4 of about 2–6 ft/sec. Superficial gas velocities in excess of about 2 ft/sec have been found to be particularly beneficial in avoiding the formation of ash deposits on the reactor walls in slope grid 42.

The gas velocity through central conduit 50 is usually maintained between 50–1000 ft/sec. Particularly preferred gas velocities are within the range of 100–600 ft/sec. These gas velocities are sufficient to permit agglomeration of the ash particles in the higher temperature zone 51 immediately adjacent to the discharge end of the conduit 50 but do not otherwise interfere with the stability and residence time distribution within fluidized bed 4 and the ability of venturi nozzle 40 to withdraw the agglomerates formed in high temperature zone 51. Preferably, to insure stability within fluidized bed 4, the ratio of the diameter of the conduit 50 to the diameter of gasifier 2 is at least 10:1 and is preferably in excess of about 20:1. The ratio of the diameter of the throat 44 to the diameter of conduit 50 is not critical and is chosen to permit the agglomerated ash formed in high temperature zone 51 to pass down into lower conduit 56.

The gas velocity of the gas entering venturi 40 surrounding centrally positioned conduit 50 is in the range of about 10–200 ft/sec. Preferred are velocities in the range of about 40–150 ft/sec. The respective velocities of the gas streams exiting centrally positioned conduit 50 and venturi 40 are such as to permit ash agglomerates to fall through constriction 44 and into conduit 56 without permitting the unconverted coal and char particle material to be removed or otherwise become segregated or classified within fluidized bed 4. The rate of ash agglomeration and ash withdrawal can be independently controlled by the proper adjustment of the oxygen concentration and/or velocity in the gases emitted upward through venturi 40 and centrally positioned conduit 50.

The ash agglomerates are permitted to fall down through conduit 56 into a water bath 60 maintained at the bottom of the gasification zone by incoming water stream 62. The water bath 60 quenches the ash agglomerates so that they can be withdrawn as a slurry from the bottom of the gasification zone via line 64.

As discussed earlier, one of the features of the present invention is the ability to recycle fine material back to fluidized bed 4. Specifically, the fine material recovered from second stage cyclone 28 is pneumatically injected via line 32 into high temperature zone 51, directly above the discharge end of the concentrically positioned conduit, to react with the oxygen containing gas discharged from conduit 50 substantially instantaneously as the gas is discharged from the conduit. This method of recycle to a specific location in the fluidized bed permits the conversion of the carbon and hydrogen content of the fine material to a valuable gaseous product while avoiding sintering and agglomeration of the fine coal particles within venturi 40.

Specific Examples of the Present Invention

EXAMPLE 1

To illustrate the effect of oxygen concentration at various points at the bottom of the fluidized bed 4, specifically along grid 42 near the exit of centrally positioned conduit 50 and near the exit of venturi 40, the following runs were performed under the conditions indicated:

TABLE 1

| | Run 126 | Run 133 |
|---|---|---|
| Coal | W. Kentucky No. 9 | W. Kentucky No. 9 |
| Gasifier Diameter | 3 ft | 3 ft |
| Venturi Diameter | 3 in | 4.5 in |
| Jet Diameter | No jet | 1.5 in |
| Temp °F. | 1815° F. | 1854° F. |
| Superficial Velocity | 5.3 ft/sec | 3.2 ft/sec |
| Grid | | |
| $O_2$ Concentration | 23.5% | 0% |
| Venturi | | |
| $O_2$ Concentration | 19.5% | 12% |
| Jet $O_2$ Concentration | — | 33% |
| Run Duration | 168 hrs. | 128 hrs. |
| Coal Feed Rate | 1036 lbs/hr | 1423 lbs/hr |
| Coal Feed | 84 Tons | 102 Tons |
| Sintering | Yes | No |

The results set forth in Table 1 illustrate that the presence of a centrally positioned conduit such as conduit 50 within a venturi withdrawal device eliminated the undesired agglomeration and sintering in the venturi.

EXAMPLE 2

Set forth in Table II below are results obtained by introducing oxygen directly through two locations in grid 42 versus a single oxygen injection through conduit 50 centrally positioned within venturi 40.

TABLE II

| | Run 126 | Run 133 |
|---|---|---|
| Coal | W. Kentucky No. 9 | W. Kentucky No. 9 |
| Gasifier Diameter | 3 ft | 3 ft |
| Venturi Diameter | 3 in | 4½ in |
| Jet Diameter | ¼in | 1.5 in |
| Jet Location | 2 jets Projecting from Grid 42 Into the Gasifier | In Center of Venturi 40 |
| Temp. °F. | 1900° F. | 1854° F. |
| Superficial Velocity | 4 ft/sec | 3.2 ft/sec |
| Sintering | Yes | No |

The results of Table II indicate a necessity to introduce high oxygen concentrations in the central portions of the venturi to avoid sintering and undistributed agglomerates within fluidized bed 4 and on grid 42.

EXAMPLE 3

To illustrate the beneficial effects associated with the recycle of fine material from second stage cyclone 28 to fluidized bed 4, a series of runs as reported in Table III were performed.

TABLE III

| Run No. | 131 | 132 | 133 |
|---|---|---|---|
| Fines Recycle From | | | |
| First-Stage Cyclone | Yes | No | Yes |
| Second-Stage Cyclone | Yes | No | No |
| Coal Feed Rate, lb/hr | 1091 | 1821 | 1733 |
| Elutritation Rate, lb/hr | 53 | 569 | 211 |
| Superficial Velocity, ft/sec | 4.2 | 3.8 | 3.6 |
| Coal Utilization Efficiency, %* | 94 | 73 | 89 |
| Size Distribution of Fines Not Recycled | | | |
| 40 mesh, wt % retained | — | 9.9 | 0.0 |
| 70 mesh | — | 8.9 | 0.6 |
| 140 mesh | — | 19.6 | 13.5 |
| 200 mesh | — | 7.4 | 15.5 |
| 230 mesh | — | 3.0 | 5.5 |
| 50 microns | 4.0 | 11.8 | 13.5 |
| 40 microns | 6.0 | 23.5 | 28.8 |
| 20 microns | 11.5 | 10.8 | 14.9 |
| 10 microns | 45.5 | 4.3 | 6.8 |
| 5 microns | 33.0 | 0.8 | 0.6 |

*Based on coal feed and coal losses in ash discharge and fines.

During these runs no sintering or undesired coal agglomeration was observed and, as the data indicates, the elutriation rate of fine coal material from the fluidized bed 4 was substantially decreased.

We claim as our invention:

1. In a process for the conversion of a solid, agglomerating hydrocarbonaceous solid to a more valuable gaseous product wherein (i) an oxygen containing gas in admixture with steam is contacted with the solid at elevated temperatures in a fluidized bed gasification reaction zone, (ii) ash is agglomerated in the bottom portion of the reaction zone, and (iii) the ash is selectively separated from the fluidized bed by withdrawing the ash from the bottom portion of the reaction zone through a withdrawal nozzle having a constricted central opening wherein the ash agglomerates have a tendency to occlude the nozzle and the central opening thereof, the improvement which comprises (a) passing an oxygen containing gas into the nozzle, through a separate conduit concentrically positioned within the nozzle, the discharge end of the conduit being positioned substantially above the constricted central opening, said oxygen containing gas passing through the separate conduit having an oxygen concentration of about 30–75% by volume, (b) passing an additional gaseous fluid upward into the fluidized bed through the withdrawal nozzle and past the outside of the separate conduit, said additional gaseous fluid having an oxygen concentration less than the oxygen concentration in the gas passing through the separate conduit, said nozzle being positioned below the fluidized bed and being concentrically surrounded by a fluid distribution and support grid, and (c) passing an additional gaseous fluid substantially free of oxygen through the fluid distribution and support grid, said oxygen containing gas, said additional gaseous fluid passing through said nozzle, and said additional gaseous fluid passing through said grid providing a superficial gas velocity of at least 2 ft/sec. through the fluidized bed.

2. The improvement of claim 1 wherein the nozzle comprises a venturi type nozzle having a central constricted section positioned between opposed conical sections positioned above and below said central constricted section.

3. The improvement of claim 2 wherein the oxygen containing gas is introduced into said venturi above the central constricted section but within the end of the upper conical section.

4. The improvement of claim 1 wherein the oxygen concentration of the additional gaseous fluid passing through said nozzle is about 0–15% by volume.

5. The improvement of claim 1 wherein the gaseous fluid passing through the grid contains less than 5% by volume oxygen.

6. The improvement of claim 1 wherein the gaseous fluid passed through the grid comprises a portion of the gaseous product produced in the gasification reaction whereby the CO and $H_2$ content of the hot reaction product is raised.

7. The improvement of claim 1 wherein the gaseous product includes entrained carbonaceous fine material, the fine material being separated from the gaseous product and passed to the fluidized reaction zone directly above the discharge end of the concentrically positioned conduit for direct contact with the oxygen containing gas substantially instantaneously as said gas is discharged from said conduit within the withdrawal nozzle.

* * * * *